US007750789B2

(12) United States Patent
Titokis et al.

(10) Patent No.: US 7,750,789 B2
(45) Date of Patent: Jul. 6, 2010

(54) HIGH-POWER BREAKER SWITCH FOR A VEHICLE

(75) Inventors: Konstantinos Titokis, Luedenscheid (DE); Volker Thurau, Dortmund (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 12/620,839

(22) Filed: Nov. 18, 2009

(65) Prior Publication Data

US 2010/0073119 A1 Mar. 25, 2010

Related U.S. Application Data

(63) Continuation of application No. PCT/EP2008/056127, filed on May 19, 2008.

(30) Foreign Application Priority Data

May 18, 2007 (DE) ..... 10 2007 023 234

(51) Int. Cl.
*H01H 85/25* (2006.01)
*H01R 13/62* (2006.01)

(52) U.S. Cl. ..... 337/194; 337/196; 337/205; 361/626; 361/642; 361/646; 361/837; 439/620.26; 439/620.29; 439/620.34; 439/620.3; 439/893

(58) Field of Classification Search ..... 337/194, 337/196, 205; 361/642, 626, 646, 837; 439/157, 439/620.26, 620.29, 620.34, 893, 620.3
See application file for complete search history.

(56) References Cited

U.S. PATENT DOCUMENTS 1,966,716 A * 7/1934 Green ..... 337/194
2,072,729 A * 3/1937 Corbett ..... 337/196
2,186,813 A * 1/1940 Adam et al. ..... 337/210
2,289,122 A * 7/1942 Jackson et al. ..... 337/188
3,030,474 A * 4/1962 Scott, Jr. ..... 337/7
3,202,788 A * 8/1965 George ..... 337/194
3,358,100 A * 12/1967 Schleicher ..... 337/194
3,379,842 A * 4/1968 Downs et al. ..... 337/146
4,851,963 A * 7/1989 Miller et al. ..... 361/643

(Continued)

FOREIGN PATENT DOCUMENTS

DE 10009605 A1 10/2000

(Continued)

*Primary Examiner*—Anatoly Vortman
(74) *Attorney, Agent, or Firm*—Brooks Kushman P.C.

(57) ABSTRACT

A breaker switch includes a connector housing having plug-in contacts and a socket housing having sockets. The connector housing has a fuse chamber having an opening through which a fuse can be inserted into the fuse chamber. A lever pivotably mounts the housings such that the connector housing is movable with the lever relative to the socket housing between starting and final positions. In the starting position the housings disengage such that the contacts and sockets disengage. In the final position the housings engage such that the contacts and sockets engage. A cover is movably connected to the connector housing to move between opened and closed positions. The cover opens the fuse chamber opening when opened and closes the fuse chamber opening when closed. When the cover is opened the cover prevents the connector housing from moving to the final position thereby preventing the contacts and sockets from electrically connecting.

12 Claims, 5 Drawing Sheets

U.S. PATENT DOCUMENTS

| | | | | |
|---|---|---|---|---|
| 4,966,561 | A * | 10/1990 | Norden | 439/620.34 |
| 5,559,662 | A * | 9/1996 | Happ et al. | 361/104 |
| 5,831,228 | A * | 11/1998 | Kuki et al. | 200/16 E |
| 5,833,484 | A * | 11/1998 | Post et al. | 439/352 |
| 5,842,560 | A * | 12/1998 | Kuki et al. | 200/43.05 |
| 5,847,338 | A * | 12/1998 | Kuki et al. | 200/17 R |
| 5,973,418 | A * | 10/1999 | Ciesielka et al. | 307/130 |
| 6,317,312 | B1 * | 11/2001 | Hashizawa et al. | 361/642 |
| 6,325,647 | B1 * | 12/2001 | May et al. | 439/157 |
| 6,333,846 | B1 * | 12/2001 | Hashizawa et al. | 361/649 |
| 6,366,449 | B1 | 4/2002 | Hashizawa et al. | |
| 6,407,656 | B1 * | 6/2002 | Konda et al. | 337/194 |
| 6,459,558 | B1 | 10/2002 | Hashizawa et al. | |
| 6,587,028 | B2 * | 7/2003 | Mollet et al. | 337/194 |
| 6,736,655 | B2 * | 5/2004 | Martin et al. | 439/157 |
| 6,781,809 | B2 | 8/2004 | Milanczak | |
| 6,997,725 | B2 * | 2/2006 | Stella et al. | 439/157 |
| 6,998,954 | B2 * | 2/2006 | Milanczak | 337/194 |
| 7,244,148 | B2 | 7/2007 | Maguire et al. | |
| 7,530,850 | B2 | 5/2009 | Maguire et al. | |
| 7,561,017 | B2 * | 7/2009 | Darr et al. | 337/79 |
| 2002/0177338 | A1 | 11/2002 | Nishide et al. | |
| 2003/0199184 | A1 * | 10/2003 | Martin et al. | 439/157 |
| 2005/0098419 | A1 | 5/2005 | Matsui et al. | |
| 2005/0215122 | A1 | 9/2005 | Nishida | |
| 2006/0019541 | A1 | 1/2006 | Maguire et al. | |
| 2007/0235313 | A1 | 10/2007 | Maguire et al. | |
| 2008/0242150 | A1 * | 10/2008 | Chikamatsu et al. | 439/620.3 |
| 2009/0246992 | A1 * | 10/2009 | Martin | 439/157 |

FOREIGN PATENT DOCUMENTS

| | | | |
|---|---|---|---|
| DE | 10021722 | A1 | 1/2001 |
| DE | 102004054360 | A1 | 6/2005 |
| DE | 102005032210 | A1 | 3/2006 |
| DE | 102005017672 | A1 | 10/2006 |
| DE | 102006001764 | A1 | 3/2007 |
| DE | 102006016274 | A1 | 10/2007 |
| EP | 1755200 | A2 | 2/2007 |
| FR | 2877138 | A1 * | 4/2006 |

* cited by examiner

HIGH-POWER BREAKER SWITCH FOR A VEHICLE

CROSS-REFERENCE TO RELATED APPLICATIONS

This application is a continuation of International Application PCT/EP2008/056127, published in German, with an international filing date of May 19, 2008, which claims priority to DE 10 2007 023 234.0, filed May 18, 2007; the disclosures of which are both hereby incorporated by reference.

BACKGROUND OF THE INVENTION

1. Field of the Invention

The present invention relates to a high-power breaker switch for a vehicle in which the breaker switch includes a connector housing having plug-in contact elements, a socket housing having socket contacts, and an operating lever which enables the plug-in contacts to be connected to and disconnected from the socket contacts.

2. Background Art

DE 10 2004 054 360 (corresponding to U.S. Pat. No. 6,982,393) describes a high-power breaker switch.

SUMMARY OF THE INVENTION

A high-power breaker switch in accordance with embodiments of the present invention is for use with electric vehicles and hybrid vehicles having an electrical drive in addition to an internal combustion engine. The breaker switch is to be used to disconnect the electrical supply of a vehicle for maintenance which is required now and then. The breaker switch is safe to the touch as the electrical supply provides relatively high currents and voltages.

Routine maintenance work on an electrical system of a vehicle also includes replacing a defective electrical fuse. It is expedient for the breaker switch to disconnect the electric circuit in order to replace the fuse. As such, it is advantageous for the fuse to be located near the breaker switch. In accordance with embodiments of the present invention, an electrical fuse is a component of the breaker switch.

An object of the present invention is a high-power breaker switch having an electrical fuse and being characterized by a design which prohibits access to a current-carrying fuse or to live fuse contacts.

In carrying out the above object and other objects, the present invention provides a high-power breaker switch having a connector housing having plug-in contact elements, a socket housing having socket contacts, an operating lever, and a cover assembly. The connector housing has a fuse chamber for holding a fuse. The fuse chamber has an opening through which a fuse can be inserted and removed from the fuse chamber. A fuse held in the fuse chamber is electrically connected with the plug-in contact elements. The operating lever pivotably mounts the connector housing to the socket housing such that the connector housing is movable with the operating lever relative to the socket housing between a starting position and a final position. In the starting position the connector housing is disengaged from the socket housing such that the plug-in contact elements are disengaged from the socket contacts. In the final position the connector housing is engaged with the socket housing such that the plug-in contact elements are engaged and electrically connected with the socket contacts. The cover assembly is movably connected to the connector housing to move between an opened position and a closed position. In the opened position the cover assembly opens the opening of the fuse chamber. In the closed position the cover assembly closes the opening of the fuse chamber. The operating lever and the cover assembly are configured such that when the cover assembly is in the opened position the cover assembly prevents the connector housing with the operating lever from moving from the starting position to the final position to thereby prevent the plug-in contact elements from engaging and electrically connecting with the socket contacts when the cover assembly is in the opened position.

In embodiments of the present invention, a high-power breaker switch includes a connector housing having plug-in contact elements, a socket housing having socket contacts, an operating lever pivotably mounted to the connector housing, and a cover. The connector housing further has a fuse chamber that can hold a fuse to be inserted into the power circuit. The fuse chamber has an opening through which the fuse can be inserted into or removed from the fuse chamber. The cover is positionable to close (and open) the opening of the fuse chamber. The cover can be formed, for example, by two cover parts arranged so that they can slide on the connector housing.

The plug-in contact elements of the connector housing cannot be electrically connected with the socket contacts of the socket housing when the cover is open. In order to accomplish this feature, the cover mechanically limits movement of the connector housing in the direction of the socket housing when the cover is opened such that the plug-in contact elements do not come into mechanical contact, and thus do not make an electrical connection, with the socket contacts. Because the connection of the connector housing with the socket housing is made through the operating lever, movement of the connector housing towards the socket housing is mechanically limited by blocking the path of the operating lever. Here the decisive thing is the position of the cover (or the cover parts) which can assume at least two positions. In a first position, the cover closes the fuse chamber thereby preventing access to the fuse or to the fuse contacts making contact with the fuse. In a second position, the cover provides open access to the fuse chamber while preventing mechanical or electrical connection of the plug-in contact elements with the socket contacts.

The above features, and other features and advantages of the present invention are readily apparent from the following detailed descriptions thereof when taken in connection with the accompanying drawings.

DETAILED DESCRIPTION OF THE PREFERRED EMBODIMENT(S)

A high-power breaker switch in accordance with embodiments of the present invention performs safety functions in connection with service work on a vehicle and makes it possible to disconnect a battery potential. The breaker switch may be used with electric vehicles and hybrid vehicles in which high currents, and often high voltages, are to be switched without danger of shock.

Figure 1:
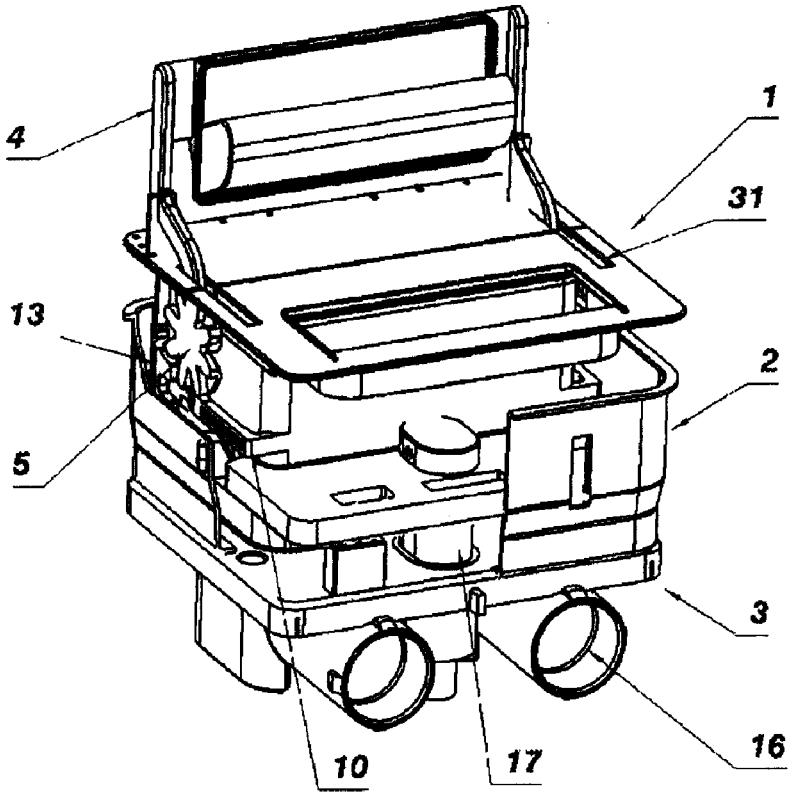
FIG. 1 illustrates a high-power breaker switch having a connector housing, a surrounding housing, a socket housing, a lever mechanism, and a cover in accordance with an embodiment of the present invention with the housings being partly connected.
Figure 2:
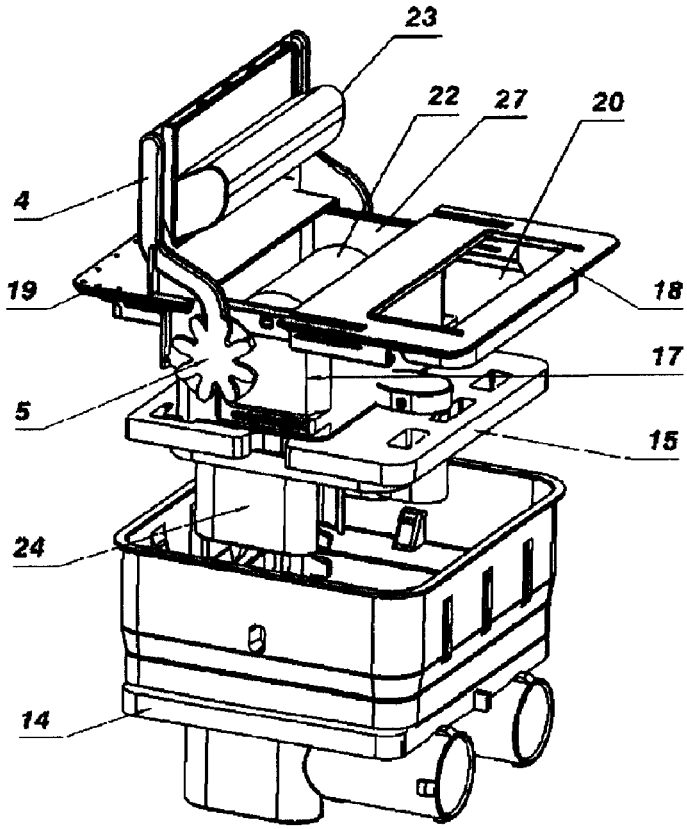
FIG. 2 illustrates an exploded view of the breaker switch.
Figure 3:
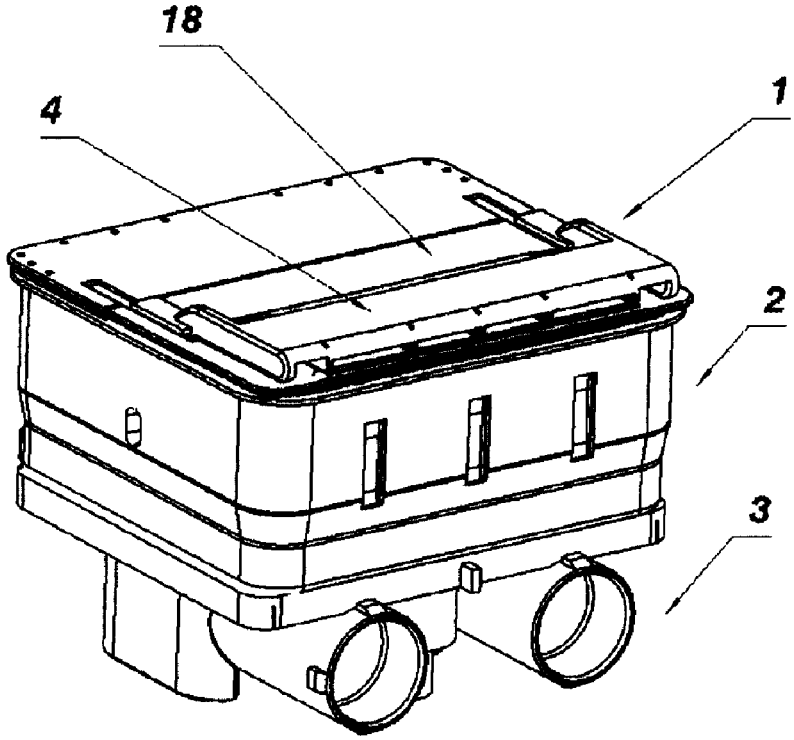
FIG. 3 illustrates the breaker switch with the housings being connected.

Referring now to FIGS. 1, 2, and 3, a high-power breaker switch in accordance with an embodiment of the present invention is shown. The breaker switch includes three housings: a connector housing 1, a surrounding housing 2, and a socket housing 3. FIG. 1 illustrates the breaker switch with housings 1, 2, and 3 partly connected. FIG. 2 illustrates an exploded view of the breaker switch. FIG. 3 illustrates the breaker switch with housings 1, 2, and 3 connected.

Connector housing 1 contains a pair of electrical plug-in contact elements. The plug-in contact elements are in the form of flat tab connectors designed for high currents. Connector housing 1 includes a base plate 15 having a contact body 24 that surrounds the plug-in contact elements. Contact body 24 is formed as a single piece on a lower surface of base plate 15. Base plate 15 has on its top surface a fuse chamber 27 for an electrical fuse 22. Fuse 22 inserted into fuse chamber 27 creates an electrically connection between the plug-in contact elements.

Socket housing 3 includes a base plate 14 having a pair of socket contacts. The plug-in contacts of connector housing 1 respectively insert into the socket contacts when connector housing 1 is joined to socket housing 3. Socket housing 3 further has a pair of power terminals 16. Electrical leads can be connected through power terminals 16 with the breaker switch. For this purpose, power terminals 16 can have plug-and-socket connectors, screw connectors, or crimp connectors arranged within socket housing 3.

The socket contacts respectively make an electrically conductive connection with power terminals 16. As such, joining connector housing 1 to socket housing 3 enables power terminals 16 to be electrically connected with one another via the electrical connections between the plug-in contact elements and the socket contacts and the electrical connections between the plug-in contact elements and fuse 22. Again, the electrical connections between the plug-in contact elements and the socket contacts occur when connector housing 1 and socket housing 3 are joined together. The electrical connections between the plug-in contact elements and fuse 22 occur when fuse 22 is inserted into fuse chamber 27.

Accordingly, when connector housing 1 and socket housing 3 are joined together, an electrical connection path is established through, in order, a first one of power terminals 16, a first one of socket contacts, a first one of plug-in contact elements, fuse 22, a second one of plug-in contact elements, a second one of contact sockets, and a second one of power terminals 16. In turn, power terminals 16 are connected to an electrical supply thereby forming a power circuit including the electrical connection path. Joining connector housing 1 with socket housing 3 electrically connects power terminals 16 with fuse 22 through the plug-and-socket connection that is made. The electrical connection can be broken in a corresponding manner by separating connector housing 1 and socket housing 3 from one another.

To ensure good protection against accidental contact, socket housing 3 is connected with surrounding housing 2. Surrounding housing 2 can be attached or formed on socket housing 3. Surrounding housing 2 is made in the form of a metal or metallized housing part that forms a surface shell of the breaker switch and shields against electromagnetic interference which may be emitted from the breaker switch.

Figure 4:
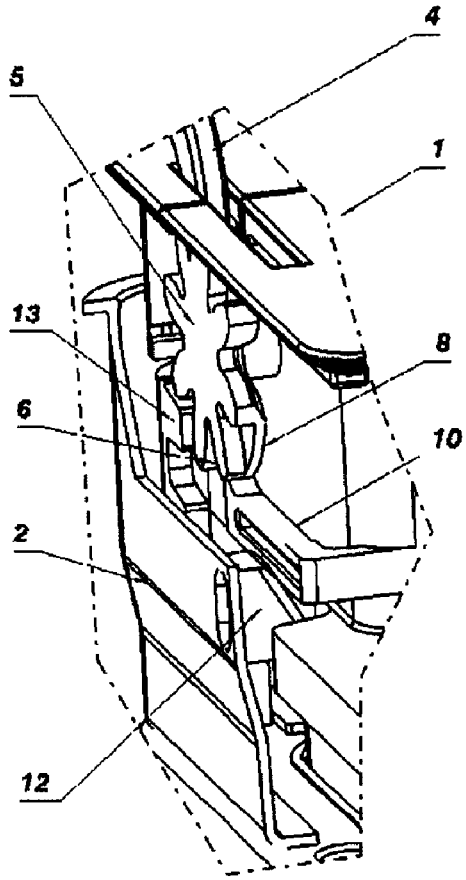
FIG. 4 illustrates the lever mechanism of the breaker switch.
Figure 5:
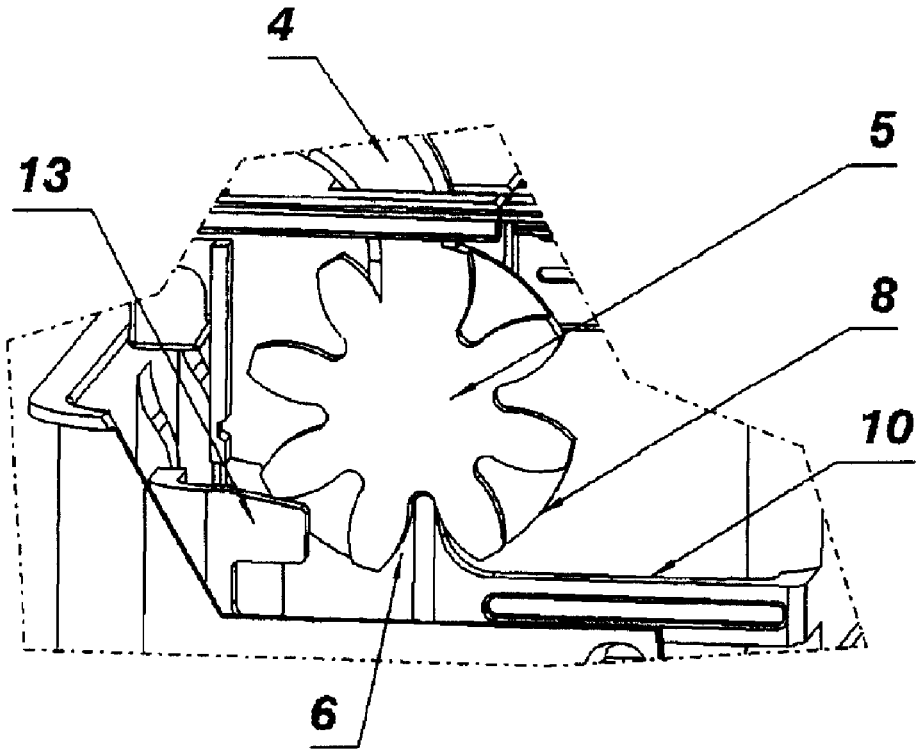
FIG. 5 illustrates a first view of a gear of the lever mechanism and a blocking lever of the connector housing.
Figure 6:
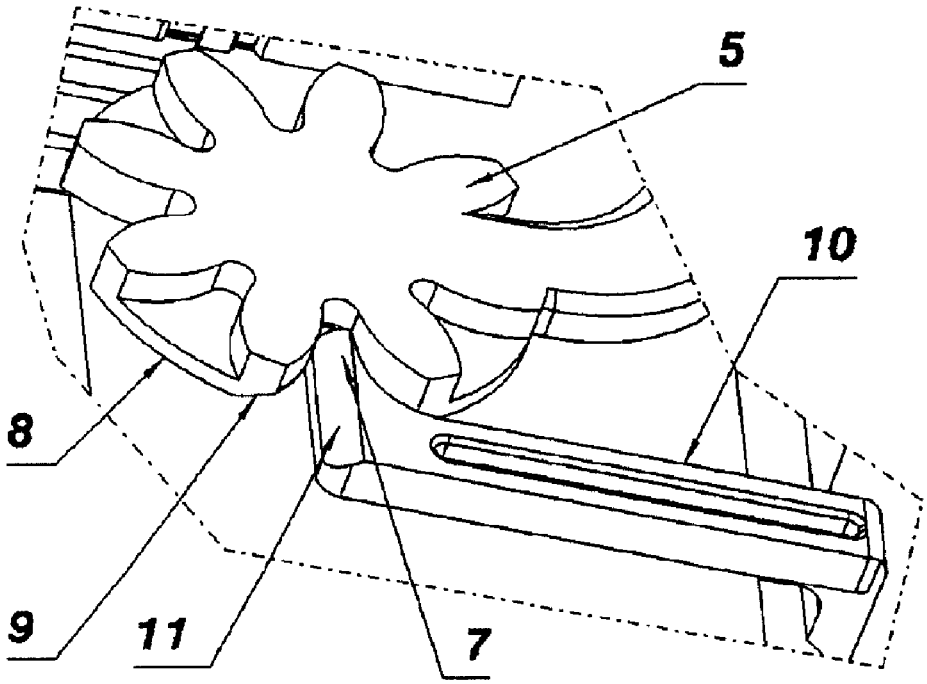
FIG. 6 illustrates a second view of the gear and the blocking lever.

Referring now to FIGS. 4, 5, and 6, with continual reference to FIGS. 1, 2, and 3, the lever mechanism of the breaker switch will be described. The lever mechanism is used to apply the relatively high insertion forces occurring in high-load plug-and-socket connections in order to join connector housing 1 with socket housing 3. The lever mechanism includes a bow-shaped operating lever 4. Operating lever 4 is pivotably mounted at two places on connector housing 1. In each mounting point, operating lever 4 forms a gear 5. Operating lever 4 with gears 5 are a single piece.

Joining connector housing 1 to socket housing 3 causes each gear 5 to mesh with a corresponding gear rack 13 formed on socket housing 3. Each gear rack 13 extends in the direction of connector housing 1. Pulling down operating lever 4 makes each gear 5 rotate with operating lever 4 about a quarter turn clockwise, causing translational motion of operating lever 4 together with connector housing 1 in the direction of socket housing 3. If operating lever 4 has been pulled down all the way (shown in FIG. 3), then connector housing 1 reaches its final position with respect to socket housing 3. In this position, the plug-in contact elements of connector housing 1 completely engage in the socket contacts of socket housing 3 and thus form electrically conductive connections.

FIGS. 4, 5, and 6 are intended to illustrate the mode of operation of the lever mechanism more clearly. FIG. 4 illustrates a section of operating lever 4 which, along with gear 5 and connector housing 1, is in a starting position. Gear 5 is in front of the top edge of gear rack 13 with which gear 5 is intended to mesh by a movement of operating lever 4.

Connector housing 1 includes a one-arm blocking lever 10. In the starting position of operating lever 4, the free end section of blocking lever 10 meshes into a first tooth space 6 of gear 5. This blocks the mobility of operating lever 4 which is connected with gear 5 as a single piece.

A control edge 12 is formed on the inside of surrounding housing 2. Control edge 12 widens downward. If connector housing 1 is now pushed in the direction of surrounding housing 2, then control edge 12 presses against the long side of blocking lever 10 thereby pushing the free end section of blocking lever 10, which is blocking gear 5, out of the plane of rotation of gear 5. This unblocks gear 5 and thus simultaneously unblocks operating lever 4. Operating lever 4 can now be pulled down, causing gear 5 to mesh with gear rack 13 of socket housing 3, pushing connector housing 1 in the direction of socket housing 3 until the plug-in contact elements are connected with the socket contacts.

The initial locking of gear 5 by blocking lever 10 prevents connector housing 1 and socket housing 3 from being joined when surrounding housing 2 is not correctly mounted. This prevents the breaker switch from making the electrical connection when there is insufficient protection against accidental contact or ineffective shielding of electromagnetic fields as a result of surrounding housing 2 being absent or wrongly positioned.

In FIG. 5, operating lever 4 is in the starting position. This is recognizable by the direction in which operating lever 4 goes away from gear 5. In the starting position, again, operating lever 4 is blocked by the meshing of blocking lever 10 into first tooth space 6 of gear 5.

In FIG. 6, operating lever 4 along with gear 5 and connector housing 1 are in a final position as a result of operating lever 4 being pulled down. In the final position, the direction in which operating lever 4 goes away from gear 5 is rotated by about 90° clockwise compared with the starting position (shown in FIG. 5). Here the free end section of blocking lever 10 engages a second tooth space 7 of gear 5. This is possible as in the final position of connector housing 1 blocking lever 10 has already moved over control edge 12 of surrounding housing 2 (see FIG. 4) and has accordingly sprung back into its original position.

To keep blocking lever 10 from engaging in a tooth space in an intermediate position, gear 5 has a flat bridge plate 8 on its back that makes tooth spaces 6, 7 accessible to blocking lever 10 only from one side of gear 5. Bridge plate 8 is only interrupted for tooth spaces 6, 7. Tooth spaces 6, 7 respectively correspond to the starting position and the final position of operating lever 4. Bridge plate 8 additionally increases the axial and radial resistance torque and thus gives gear 5 increased torsional stiffness. Because control edge 12 presses blocking lever 10 behind bridge plate 8 of gear 5 (visible in FIG. 4) blocking lever 10 is prevented from springing back into its starting position until reaching second tooth space 7 of gear 5 which corresponds to the final position of operating lever 4.

The blocking of operating lever 4 in its final position is advantageous as this prevents accidental or spontaneous opening of the breaker switch due to mechanical effects such as, for example, vibrations of the vehicle body.

Figure 7:
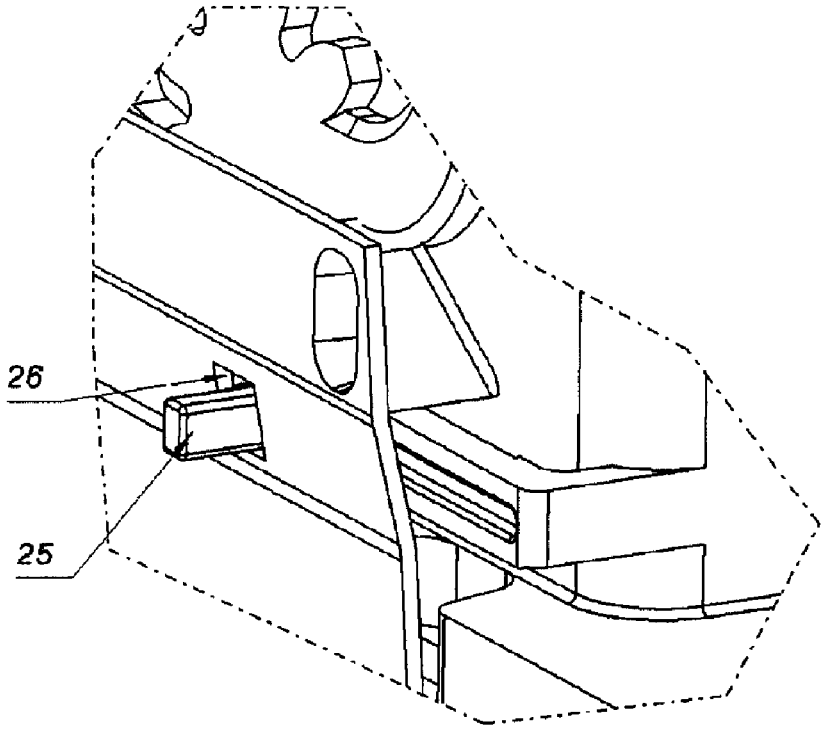
FIG. 7 illustrates a release pin of the breaker switch.

With reference to FIG. 7, the breaker switch may be provided with an unlocking pin 25 for unlocking the blocked operating lever 4. Unlocking pin 25 projects through an unlocking opening 26 in the wall of surrounding housing 2. Unlocking pin 25 is either mounted on surrounding housing 2 or formed on blocking lever 10.

Figure 8:
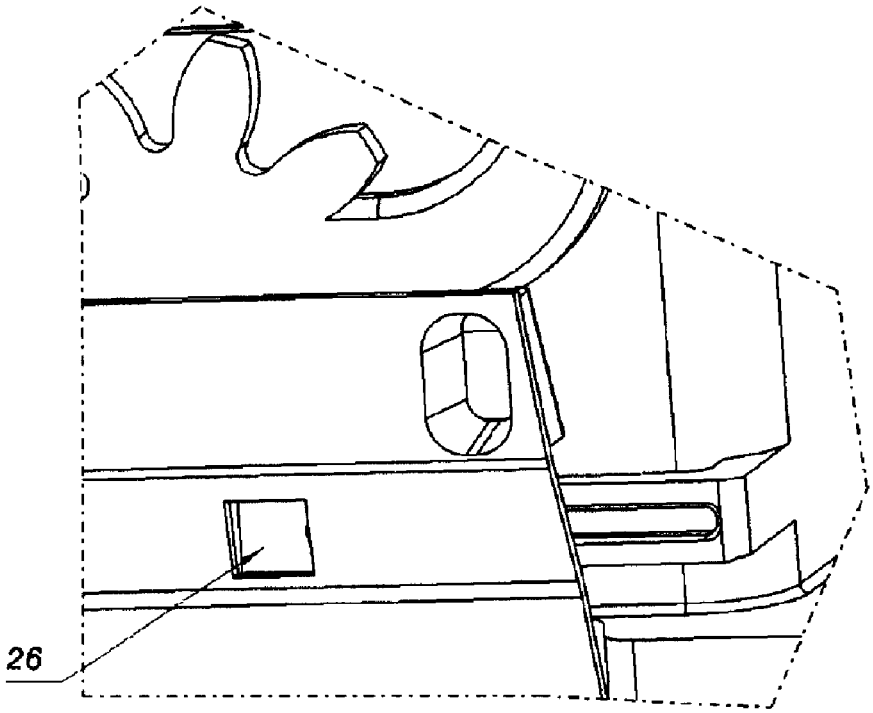
FIG. 8 illustrates a release opening of the breaker switch.

The assembly engineering is even simpler if there is no unlocking pin but only an unlocking opening 26 in surrounding housing 2. With reference to FIG. 8, this configuration is shown. By inserting a pin-like object such as a narrow screwdriver into unlocking opening 26 it is possible to move blocking lever 10 to release gear 5 and thus to release operating lever 4. Chamfers 9, 11 respectively on the back of gear 5 and the free end section of blocking lever 10 (shown in FIG. 6) assist in blocking lever 10 sliding out of tooth space 6.

Connector housing 1 and socket housing 3 also include plug-in contact elements designed for low electrical power. These plug-in contact elements can be connected together and are collectively referred to below as a signal connector 17. The housing contour of signal connector 17 is shown in FIGS. 1 and 2.

When connector housing 1 and socket housing 3 are joined together, signal connector 17 closes an electrical signal circuit (i.e., "signal circuit") that signals the connection state of the breaker switch. This signal can be provided to trigger an electronic or electro-mechanical relay that is inserted into the power circuit of the breaker switch, so that the breaker switch can connect and disconnect the power contacts free of current and voltage. This requires that the closing of the signal circuit lags behind that of the power circuit and that the opening of the signal circuit is ahead of that of the power circuit. Thus, when the breaker switch is disassembled (i.e., when connector housing 1 is separated from socket housing 3), the signal circuit is first interrupted by rotary movement of operating lever 4. This movement and subsequent translational motion of housings 1, 3 away from one another causes the power circuit to subsequently open. The sequence when housings 1, 3 are connected takes place in the reverse order.

The power circuit has electrical fuse 22 inserted into it as an overload protection. As FIG. 2 illustrates, fuse 22 is arranged in fuse chamber 27 of connector housing 1. Fuse chamber 27 can be closed by the cover. The cover can be a single part or multiple parts. In the embodiment of the breaker switch shown in the FIGS., the cover includes two cover parts 18, 19 (see FIG. 2). Cover parts 18, 19 are movable relative to an access opening of fuse chamber 27. In order to accomplish such movement, cover parts 18, 19 are connected in a captive manner to connector housing 1 and guided like drawers on an edge section of connector housing 1. It is advantageous for the guideways to have catches so that it is possible to feel when cover parts 18, 19 are in the completely opened and closed cover positions by their snapping in.

If cover parts 18, 19 are in the closed position closing fuse chamber 27, then cover parts 18, 19 are surrounded by the bow of operating lever 4. Operating lever 4 can move in slot-shaped openings 31 in cover parts 18, 19.

First cover part 18 has a cutout 20 whose shape matches that of a shaped part 23 on the bow of operating lever 4. Shaped part 23 of operating lever 4 can be lowered into cutout 20. However, this is only possible when first cover part 18 is in a position in which first cover part 18 closes fuse chamber 27 to at least a large extent. Otherwise, shaped part 23 of operating lever 4 strikes the surface of first cover part 18.

Figure 9:
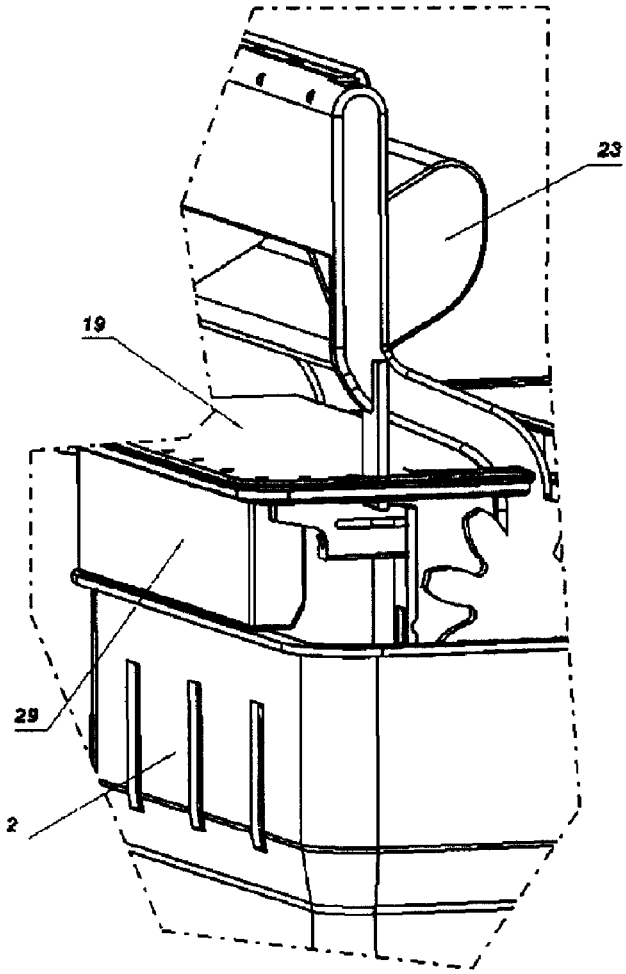
FIG. 9 illustrates a first view of a cover part and the surrounding housing.
Figure 10:
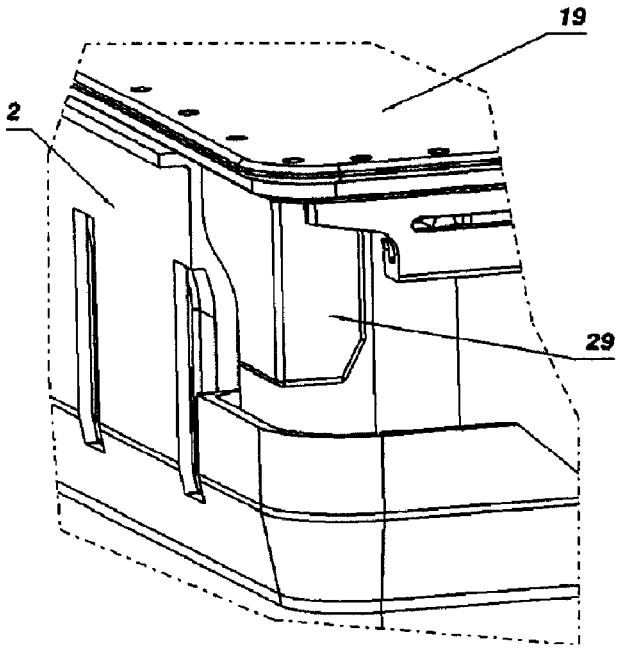
FIG. 10 illustrates a second view of the cover part and the surrounding housing.

In order for connector housing 1 to be able to be joined to socket housing 3, second cover part 19 has to also be brought into the closed position. Otherwise, a tab on second cover part 19 strikes an edge of surrounding housing 2 during the insertion motion as can be seen in FIG. 9. In contrast, if second cover part 19 is in the closed position closing fuse chamber 27, then tab 29 projects into surrounding housing 2 as can be seen in FIG. 10. As a result, connector housing 1 can be joined to socket housing 3.

FIG. 10 further illustrates that when connector housing 1 is joined to socket housing 3, fuse chamber 27 cannot be opened by a lateral displacement of second cover part 19 as tab 29 is now blocked by the inside wall of surrounding housing 2. First cover part 18 also has a tab that acts in the same way.

If operating lever 4 has been pulled down all the way and consequently power terminals 16 are electrically connected with one another, then shaped part 23 of operating lever 4 is lowered into cutout 20 of second cover part 18. This is shown in FIG. 3. The insertion of shaped part 23 of operating lever 4 fixes the position of first cover part 18 such that first cover part 18 cannot be moved as long as operating lever 4 is pulled down.

This means that the connection of housing parts 1, 3 is only possible once cover parts 18, 19 completely close fuse chamber 27. It is also only possible to open cover parts 18, 19 once connector housing 1 has been separated from socket housing 3. This makes it impossible to access the inside of fuse chamber 27 when the breaker switch is carrying current or voltage.

A summary of the mode of operation of the high-power breaker switch follows. The breaker switch is assembled in two steps. The moving part of the breaker switch undergoes translational motion in the plugging direction. This closes the power circuit. The process is limited after the locked operating lever 4 touches gear rack 13 of the fixed part (i.e., socket housing 3) of the breaker switch. At the end of the first assembly step, operating lever 4 is released to rotate over control edge 12 in surrounding housing 2. The following rotation additionally closes the signal circuit.

Operating lever 4 mounted on the breaker switch is, in the state in which it is delivered, locked by blocking lever 10. It is unlocked by control edge 12 inside surrounding housing 2, which deflects blocking lever 3 during the assembly process, thereby releasing operating lever 4. Bridge plate 8 formed between gear tooths 6, 7 prevents blocking lever 10 from swinging back into its starting position during the following rotation.

The locking of operating lever 4 and because its release by control edge 12 is required ensures that surrounding housing 2 is assembled properly.

The final assembly of the breaker switch is accomplished by the subsequent rotation of operating lever 4. This causes gear 5 on operating lever 4 to mesh with gear rack 13 of socket housing 3. After the end of the rotation process, blocking lever 10 swings back into its starting position. Thus, blocking lever 10 is only under mechanical stress during the assembly process.

Fuse 22 is accessed through cover parts 18, 19 that can be moved transverse to the plugging direction. In the closed condition, cover parts 18, 19 obstruct access to fuse 22. Cover parts 18, 19 have tabs on the bottom that serve as code scanners. When cover parts 18, 19 are closed, the tabs serve as a guide on the inside of surrounding housing 2 during the assembly process. By contrast, when cover parts 18, 19 are in the opened position, the tabs collide with surrounding housing 3. The tabs are dimensioned such that the translational movement of the assembly process is interrupted early when the tabs collide with surrounding housing 2.

The assembly process of the breaker switch can only be completed when cover parts 18, 19 correctly block access to fuse 22, i.e., when cover parts 18, 19 are in the closed position. After the rotation of operating lever 4 is complete, the tabs of cover parts 18, 19 are inside surrounding housing 2 thereby locking cover parts 18, 19 against displacement. Cover parts 18, 19 are additionally fixed by the engagement of shaped part 23 of operating lever 4 into cutout 20 in first cover part 18.

To open fuse chamber 27 the corresponding assembly steps are carried out in reverse order. Therefore, a fuse change requires disassembly of the breaker switch, and thus interruption of the electrical connections.

LIST OF REFERENCE NUMBERS

1 Connector housing
2 Surrounding housing
3 Socket housing
4 Operating lever
5 Gear
6, 7 Tooth spaces
8 Bridge plate
9 Chamfer (on gear)
10 Blocking lever
11 Chamfer (on blocking lever)
12 Control edge
13 Gear rack
14 Base plate (on socket housing)
15 Base plate (on connector housing)
16 Power terminals
17 Signal connector
18 First cover part
19 Second cover part
20 Cutout (in cover)
22 Fuse
23 Shaped part (on operating lever)
24 Contact body
25 Unlocking pin
26 Unlocking aperture
27 Fuse chamber
29 Tab
31 Slot-shaped openings While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A high-power breaker switch comprising:

a connector housing having plug-in contact elements, wherein the connector housing has a fuse chamber for holding a fuse, wherein the fuse chamber has an opening through which the fuse can be inserted and removed from the fuse chamber, wherein a fuse held in the fuse chamber is electrically connected with the plug-in contact elements;

a socket housing having socket contacts;

an operating lever pivotably mounting the connector housing to the socket housing such that the connector housing is movable with the operating lever relative to the socket housing between a starting position and a final position, wherein in the starting position the connector housing is disengaged from the socket housing such that the plug-in contact elements are disengaged from the socket contacts, wherein in the final position the connector housing is engaged with the socket housing such that the plug-in contact elements are engaged and electrically connected with the socket contacts; and a cover assembly movably connected to the connector housing to move between an opened position and a closed position, wherein in the opened position the cover assembly opens the opening of the fuse chamber, wherein in the closed position the cover assembly closes the opening of the fuse chamber;

wherein the operating lever and the cover assembly are configured such that when the cover assembly is in the opened position the cover assembly prevents the connector housing with the operating lever from moving from the starting position to the final position thereby preventing the plug-in contact elements from engaging and electrically connecting with the socket contacts when the cover assembly is in the opened position.

2. The switch of claim 1 wherein:

the cover assembly includes first and second cover parts.

3. The switch of claim 2 wherein:

the cover parts are connected in a captive manner with the connector housing.

4. The switch of claim 2 wherein:

the cover parts are guided like drawers on the connector housing.

5. The switch of claim 2 wherein:

the cover parts are snapped together with the connector housing in the opened position and in the closed position.

6. The switch of claim 2 wherein:

a first one of the cover parts has a cutout into which a shaped part of the operating lever engages when the cover assembly is in the closed position.

7. The switch of claim 2 wherein:

at least one of the cover parts has a tab.

8. The switch of claim 2 wherein:

the cover parts have slot-shaped openings for the movement of the operating lever.

9. The switch of claim 1 wherein:

when the connector housing is in the final position the plug-in contact elements and the socket elements along with the fuse in the fuse chamber form a power circuit.

10. The switch of claim 9 wherein:

the connector housing and the socket housing have another corresponding set of plug-in contact elements and socket contacts which engage and electrically connect to form a signal circuit when the connector housing is in the final position.

11. The switch of claim 1 further comprising:

a surrounding housing, wherein the surrounding housing is connected with the socket housing.

12. The switch of claim 11 wherein:

the surrounding housing includes metal.

* * * * *